US005993156A

United States Patent [19]

Bailly et al.

[11] Patent Number: 5,993,156

[45] Date of Patent: Nov. 30, 1999

[54] TURBINE VANE COOLING SYSTEM

[75] Inventors: Yves Maurice Bailly, Saint Fargeau Ponthierry; Xavier Gérard AndréCoudray, Chagny; Mischael Francois Louis Derrien, Mouy sur Seine; jean-Michel Roger Fougeres, Angers; Philippe Christian Pellier, Melun; Jean-Claude Christian Taillant, Vauz le Penil; Thierry Henri Marcel Tassin, Brunoy; Christophe Bernard Texier, Francaise, all of France

[73] Assignee: Societe Nationale d'Etude et de Construction de Moteurs d'Aviation SNECMA, Paris, France

[21] Appl. No.: 09/104,200

[22] Filed: Jun. 25, 1998

[30] Foreign Application Priority Data

Jun. 26, 1997 [FR] France ..... 97 07988

[51] Int. Cl.[6] ..... F01D 5/18; F01D 9/06

[52] U.S. Cl. ..... 416/96 A; 416/90 R; 416/92; 416/97 R; 416/97 A; 415/115

[58] Field of Search ..... 415/115; 416/90 R, 416/92, 96 A, 97 R, 97 A

[56] References Cited

U.S. PATENT DOCUMENTS

| | | | |
|---|---|---|---|
| 2,843,354 | 7/1958 | Smith et al. . | |
| 4,035,102 | 7/1977 | Maghon | 416/97 R |
| 4,173,120 | 11/1979 | Grosjean et al. . | |
| 4,407,632 | 10/1983 | Liang | 416/97 R |
| 4,992,026 | 2/1991 | Ohtomo et al. . | |
| 5,002,460 | 3/1991 | Lee et al. | 416/96 A |
| 5,259,730 | 11/1993 | Damlis et al. | 416/96 A |
| 5,395,212 | 3/1995 | Anzai et al. | 416/97 R |
| 5,464,322 | 11/1995 | Cunha et al. . | |
| 5,472,316 | 12/1995 | Taslim et al. | 416/97 R |
| 5,695,322 | 12/1997 | Jacobson et al. | 416/97 R |

FOREIGN PATENT DOCUMENTS

| | | | |
|---|---|---|---|
| 2 311 176 | 12/1976 | France . | |
| 2 678 318 | 12/1992 | France . | |
| 853 534 | 10/1952 | Germany . | |
| 33 06 894 | 8/1984 | Germany . | |
| 651830 | 4/1951 | United Kingdom | 416/96 A |
| 728834 | 4/1995 | United Kingdom | 416/96 A |

*Primary Examiner*—Christopher Verdier
*Attorney, Agent, or Firm*—Bacon & Thomas, PLLC

[57] ABSTRACT

A turbine vane-system cooling system uses three internal cooling cavities (11, 12, 13) separated by two radial walls (9, 10). The upstream cavity (11) uses a helical ramp (30) and is fed through an intake (22) at the vane root (3). The middle cavity (12) also is fed at the vane root (3) and includes a compartmented, multi-perforated lining (40). The air is exhausted from each compartment through impact orifices and enters the succeeding compartment through slots (42) and then is finally exhausted through a vane-head orifice (21). The vane side walls opposite the downstream cavity (13) have double skins with bridging elements. The air passes through these double skins but circulates centrifugally in the upstream portion (15) of the downstream cavity (13) and enters this cavity's downstream portion (16) to be exhausted through slots (19) in the trailing edge (6). A third wall (14) divides the downstream cavity (13) into two parts (15, 16).

7 Claims, 11 Drawing Sheets

TURBINE VANE COOLING SYSTEM

BACKGROUND OF THE INVENTION

The invention relates to cooling high-pressure turbine-vanes of gas-turbine engines, including both stationary and movable vanes.

The stationary and movable vanes of high-pressure turbines, in particular the blade portions, are exposed to the high temperatures of the combustion gases of the combustion chamber of the gas turbine engine. The blades of these vanes therefore are fitted with cooling devices fed with cooling air taken from the area of the high-pressure compressor. This cooling air moves through circuits inside the vanes and then is evacuated into the flow of hot gases moving across the vanes.

As regards the movable vanes, the cooling air enters the airfoils through the vane roots, however, in the case of stationary vanes, the cooling air may be introduced through a base plate either at the vane root or at its head, the vane root being the vane end nearest the turbine's axis of rotation.

The objective of the invention is to provide a turbine vane wherein the cooling device optimally exploits the cooling capacity of the circulating cooling air in order to reduce the ventilation flow and hence to increase the engine efficiency.

BRIEF SUMMARY OF THE INVENTION

The invention relates to a turbine vane comprising a hollow blade extending radially between a vane root and a head end and including a leading and a trailing edge, said edges being separated from one another by spaced concave and convex side walls (high pressure and low pressure sides) and further including an air cooling system inside the vane using air supplied from the vane root that guides the cooling air against the inside surfaces of the vane side walls.

This vane of the invention further comprises two radial walls connecting the concave and convex side walls and dividing the inside of the vane into an upstream cooling cavity located near the vane leading edge, a middle cooling cavity located between the radial walls and a downstream cooling cavity located near the trailing edge, and wherein the upstream and the middle cavities are supplied with air through an intake at the vane root, the air then being evacuated from the cavities through exhaust orifices in the vane head. The downstream cavity is fed with air through a separate intake at the vane root and this air is exhausted through a plurality of slots in the trailing edge.

The cooling system comprises a helically winding inclined ramp in the upstream cavity, herein called a helical ramp, extending between the vane root and vane head; a line in the middle cavity in contact with the insides of the radial walls and away from the vane side walls by projecting elements, the lining including a plurality of orifices adjacent but opposite the side walls of the vane for directing cooling air against these walls, and in the downstream cavity, a transverse wall sealing the lower end of said cavity and a third radial wall dividing said cavity into an upstream portion and a downstream portion near the trailing edge are provided, said two portions communicating with each other through an aperture at the base of the said third wall. The vane side walls opposite the upstream portion consist of double skins connected by bridging elements. A flow of cooling air is introduced at the vane root and passes between said skins, said flow next entering the upstream part of the vane and then entering the downstream part through said aperture from where it is exhausted through the plurality of slots.

Advantageously the inside wall of the first or upstream cavity comprises perturbation means. These perturbation means may be ribs, studs or bridging elements connecting the vane inside wall to the core of the helical ramp.

Advantageously the lining of the middle cavity comprises a plurality of juxtaposed compartments consecutively fed by the same air flow. The first compartment is fed with air through the vane root and the ensuing compartments are fed with air from the preceding compartment that have impact the vane's sidewalls and flowed through slots in the walls of the lining underneath the projecting transverse rib elements.

The helical ramp in the first cavity allows substantially increasing the internal heat-exchange coefficient relating to vane cooling at the leading-edge zone.

The cascaded impact system in the middle compartment allows full utilization of the cooling-air potential before said air is reintroduced into the main flow.

The bridging-element system present in the downstream compartment provides effective cooling near the hot zones that is easily controlled.

The combustion of these cooling technologies allows optimizing cooling obtained from cooling ventilation flow through the turbine vane-systems by exploiting to the fullest the air cooling potential, and by thermal dimensioning, leading to optimal mechanical service life.

The design of the vane of the invention enables lowering the cooling ventilation flow and hence increases engine efficiency.

BRIEF DESCRIPTION OF THE DRAWINGS

Other features and advantages of the invention are described in the following illustrative and non-restrictive description and the attached drawings, wherein.

DETAILED DESCRIPTION OF THE PREFERRED EMBODIMENTS OF THE INVENTION

Figure 1:
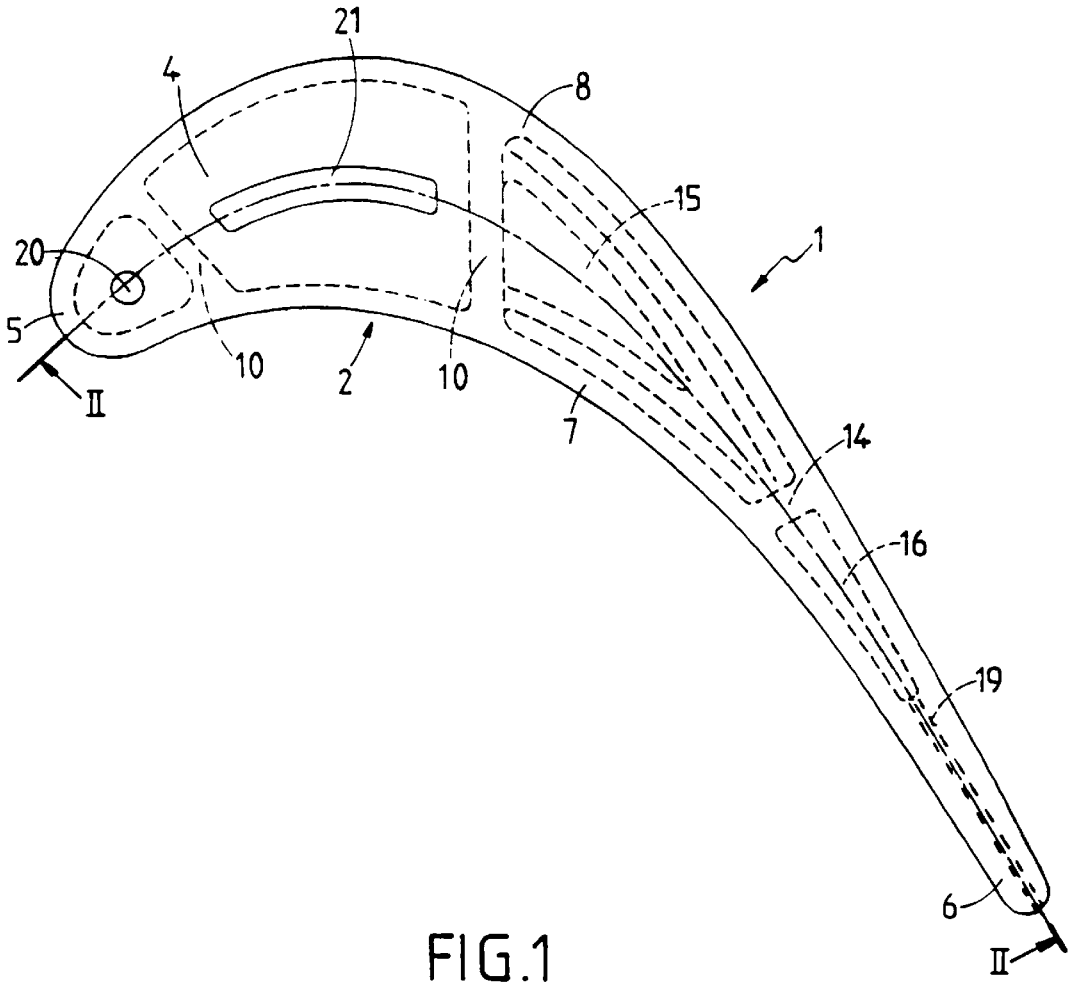
FIG. 1 is a top view of the turbine vane made in accordance with the invention.

With reference to the drawings, movable vane 1 of a high-pressure turbine comprises a hollow airfoil or blade wall 2 which extends radially between a vane root 3 and a vane head 4. The blade wall 2 comprises four distinct zones: a rounded leading edge 5 facing the hot gas flow from the engine combustion chamber, a tapered trailing edge 6 remote from the leading edge and connected to it by a concave side wall 7 denoted the "high-pressure side" and a convex side wall 8 denoted the "low-pressure side" spaced from the wall 7.

The side walls 7 and 8 are connected by two radial walls 9 and 10 dividing the inside of the vane 1 into three cooling cavities, namely an upstream or first cavity 11 very near the leading edge 5, a middle or second cavity 12 located between the two radial walls 9 and 10 and a downstream or third cavity 13 adjacent the trailing edge 6. The downstream cavity 13 is the widest of the cavities and takes up approximately two-thirds of the chordwise width of the vane 1.

A third radial wall 14 divides the downstream cavity 13 into an upstream portion 15 closer to the middle cavity 12 and a downstream portion 16 near the trailing edge 6. A transverse wall 17 closes the lower end of the downstream cavity 13. The upstream and downstream portions 15 and 16 respectively communicate with each other through an aperture 18 located at the base of the third wall 14. A plurality of cooling air outlet slots 19 are provided in the tapered portion of the trailing edge 6 and provide communication between the downstream portion 16 of the downstream cavity 13 with the combustion-gas flowing along the side walls 7 and 8 of the vane 1.

Figure 2:
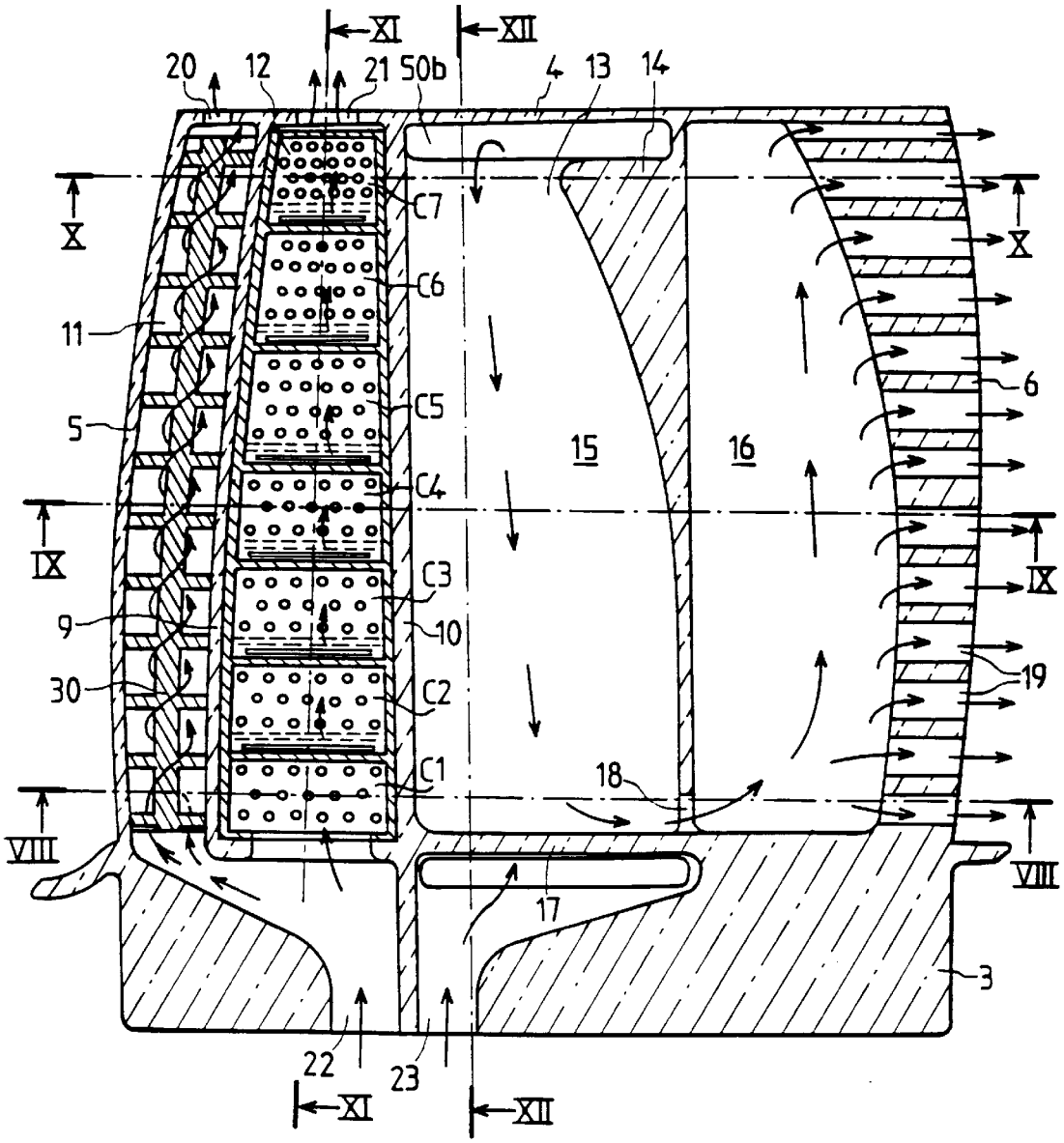
FIG. 2 is a vertical section view of the vane of FIG. 1, said section being taken along the curved axial surface denoted by the line II—II in FIG. 1.

As shown in FIGS. 1 and 2, an orifice 20 is provided in the wall of the vane head 4 at the top of the upstream cavity 11 and a second oblong orifice 21 is provided in the vane head 4 above the middle cavity 12.

Figure 12:
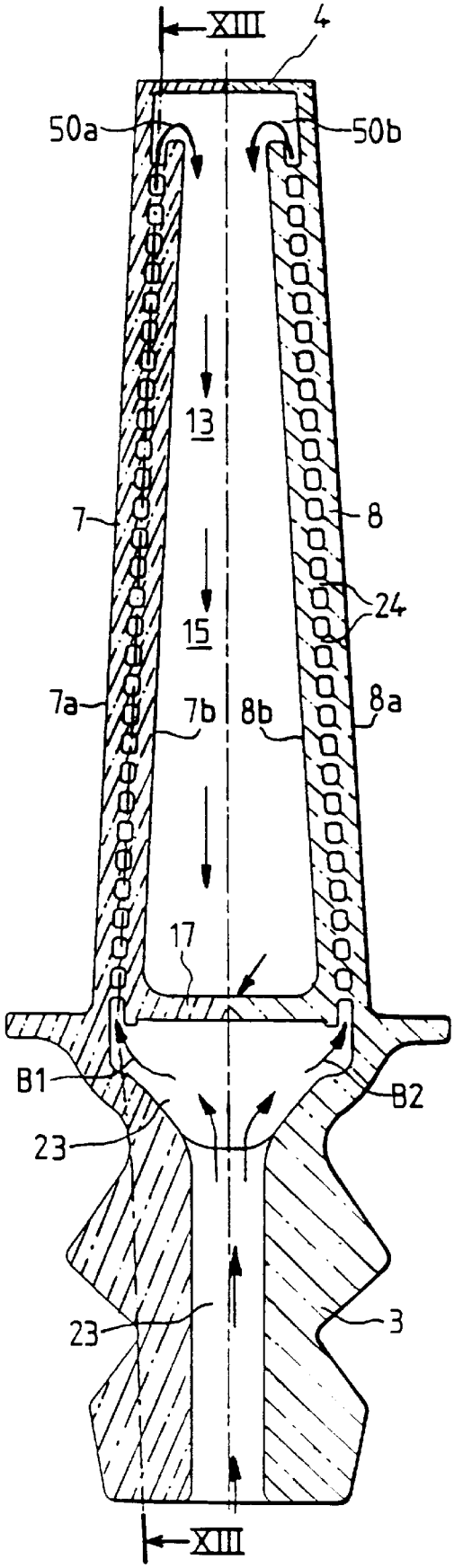
FIG. 12 is a cross-section view of the vane of FIG. 2 in a radial plane passing through the downstream or third cooling cavity along line XII—XII in FIG. 2.
Figure 13:
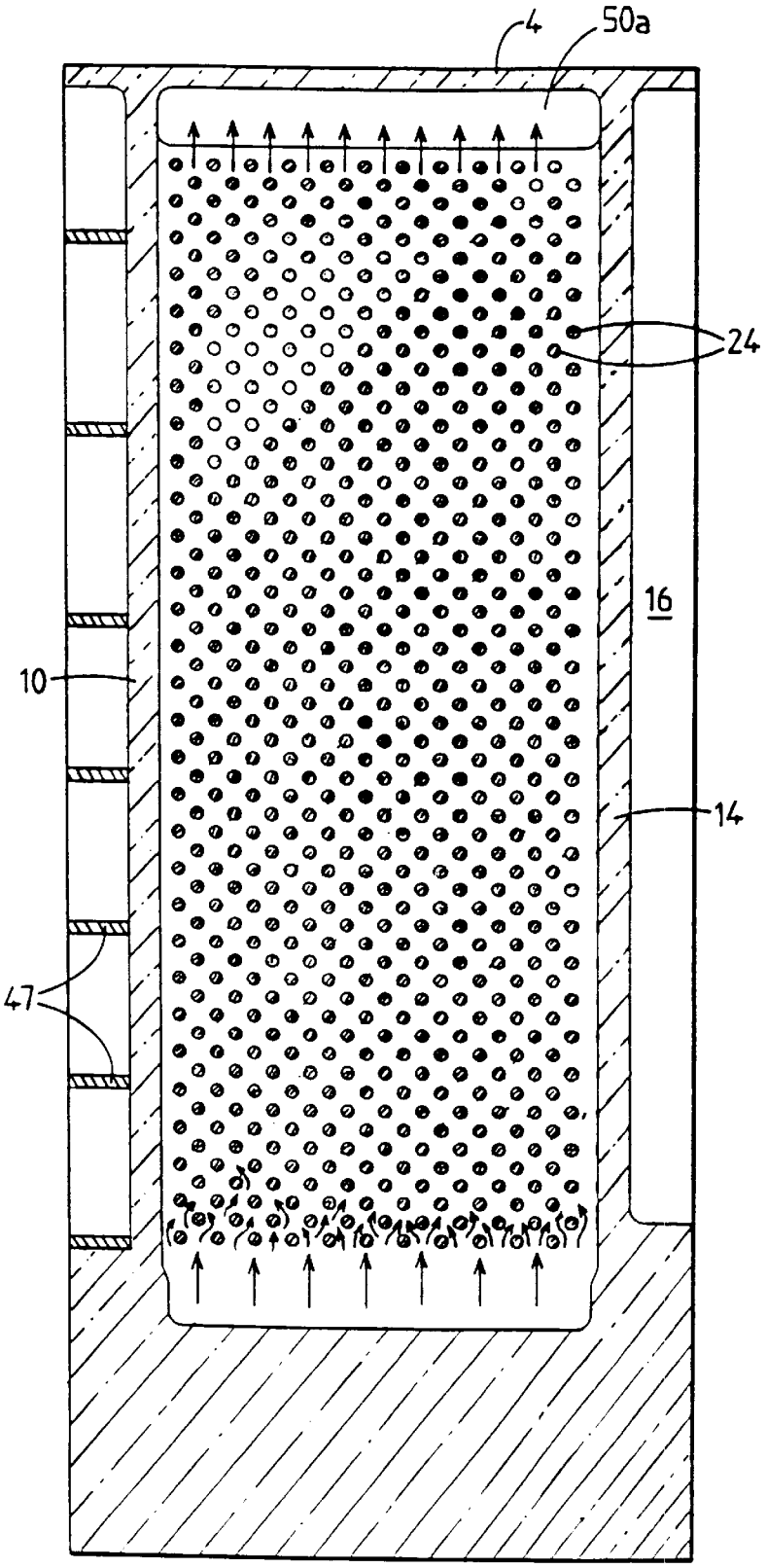
FIG. 13 is a cross-section view along a median plane of a double skin forming the outer wall of the downstream cooling cavity, where said plane is denoted by the line XIII—XIII in FIG. 12.
Figure 14:
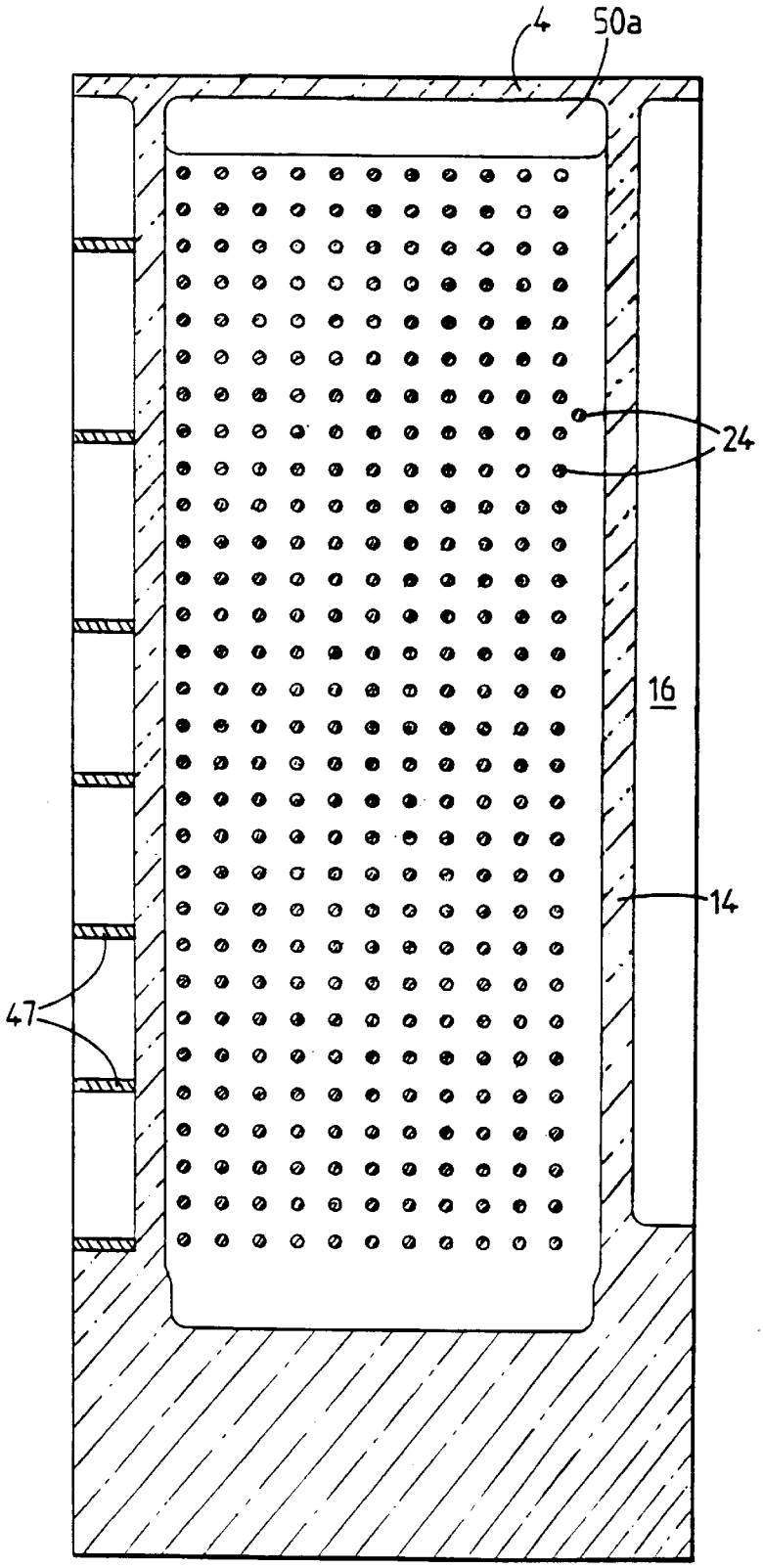
FIG. 14 is similar to FIG. 13 and shows another configuration of the bridging elements connecting the double skins.

Two separate conduits 23 supplying cooling air are provided in the vane root 3. The first conduit 22 directly feeds cooling air to the lower ends of the upstream cavity 11 and of the middle cavity 13 as shown in FIGS. 1 and 2, whereas the second conduit 23 feeds cooling air to the upstream portion 15 of the downstream cavity 13 in the vicinity of the vane head 4, said air having passed inside the two side walls 7 and 8, comprising two skins connected by bridging elements 24 facing the upstream cavity portion 15 as shown in FIGS. 12–14.

In the vicinity of the blade portion 2, the vane 1 is formed of two half vanes which ultimately are welded together, the separation of the two half vanes occurring near the median line; alternatively, the vane may be manufactured by casting.

As shown in FIGS. 2 through 7, the upstream cavity 11 situated near the leading edge 5 is cooled convectionally by using a helical ramp 30.

Said ramp 30 may be cast and be integral with a half vane, or it may be mounted into the upstream cavity 11 and welded.

In the latter case, advantageously a material offering high-thermal conductivity is used to increase the cooling effectiveness of this ventilation circuit.

Figure 3:
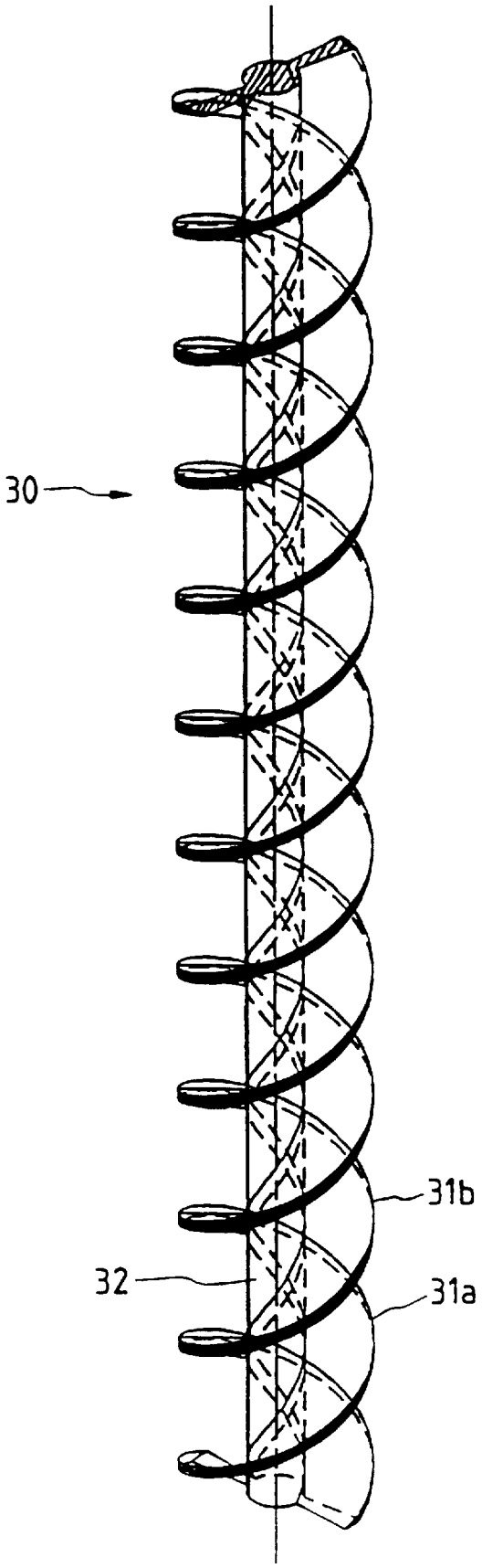
FIG. 3 is a perspective view of the helical ramp mounted in the first or upstream cooling cavity.

The helical ramp 30 shown in FIG. 3 comprises two helices 31*a*, 31*b*, however, it may comprise only one helix, or more than two, as desired.

The central body, or core 32, of the ramp 30 is not necessarily cylindrical, and its cross-section may vary over its height in order to selectively control the cooling-air passage cross-section to regulate the values of the heat-exchange coefficients.

The cooling air moves in the upstream cavity 11 in a helical cooling path starting at the vane root 3 and ending at the vane head 5 from where the air is exhausted through the orifice 20. Said system substantially lengthens the air flow path and, at constant cooling output, increases air flow relative to that which is possible in a purely radial cavity.

In this manner the magnitude of the heat-exchange coefficient is raised. Moreover this spinning flow enhances the heat exchange at the vane wall near the leading edge 5, the air being projected centrifugally towards the outside of the helical ramp 30.

Figure 4:
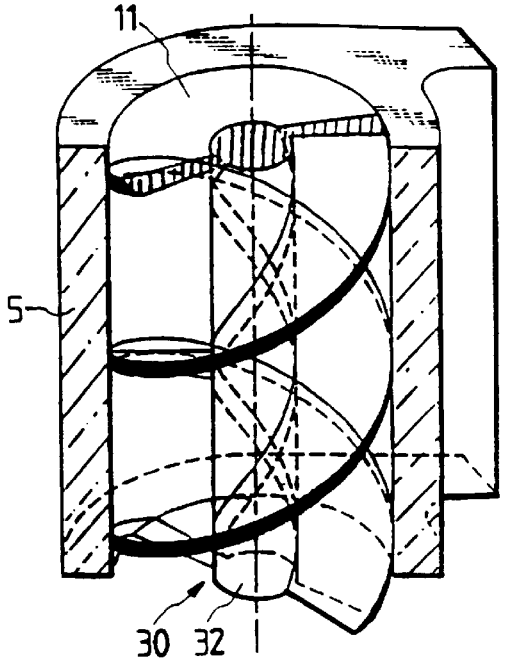
FIGS. 4–7 are cutaway views of the vane's leading edge area showing the configuration of the helical ramp in the upstream cooling cavity, and diverse forms of perturbation means.

As shown in FIGS. 4 though 7, several configurations are suggested as regards the helical ramp 30.

In FIG. 4 the helical ramp is located in the upstream cavity 11 wherein the inside wall is smooth.

Figure 5:
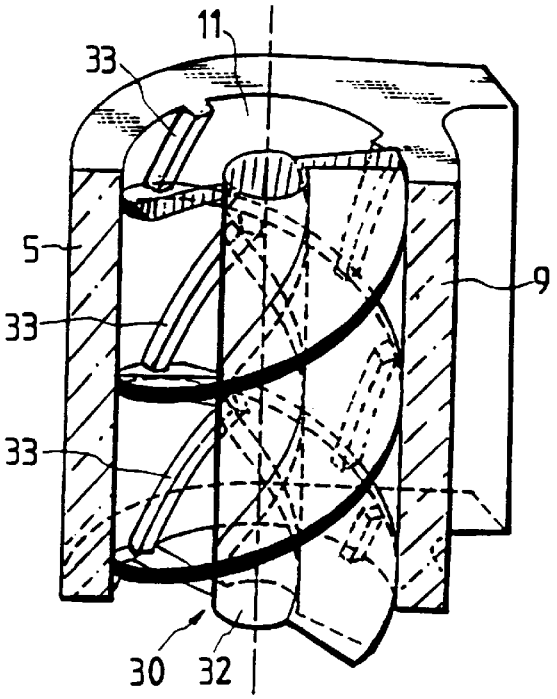

In FIG. 5, perturbation devices 33 in the form of sloping ribs are mounted either on the inner wall of the upstream cavity 11 or on the helical ramp.

Figure 6:
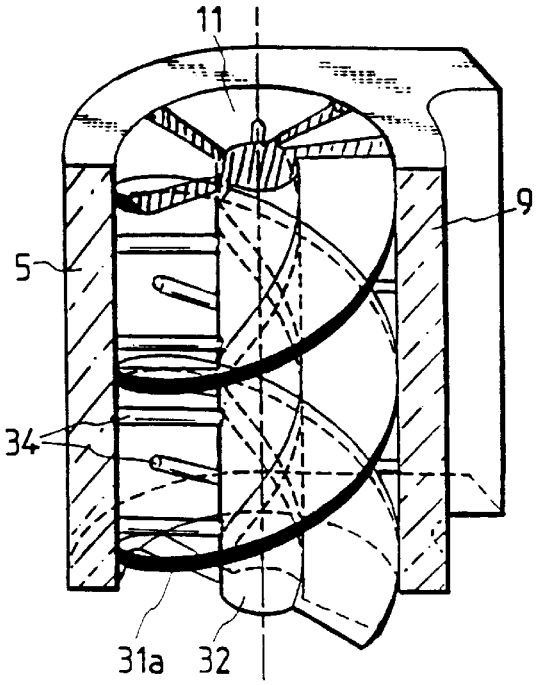

As shown in FIG. 6, the perturbation devices may consist of bridging elements 34 connecting the inner wall of the upstream cavity 11 to the core 32 of the helical ramp 30. These bridging elements 34 may be relatively staggered from one tier to the next.

Figure 7:
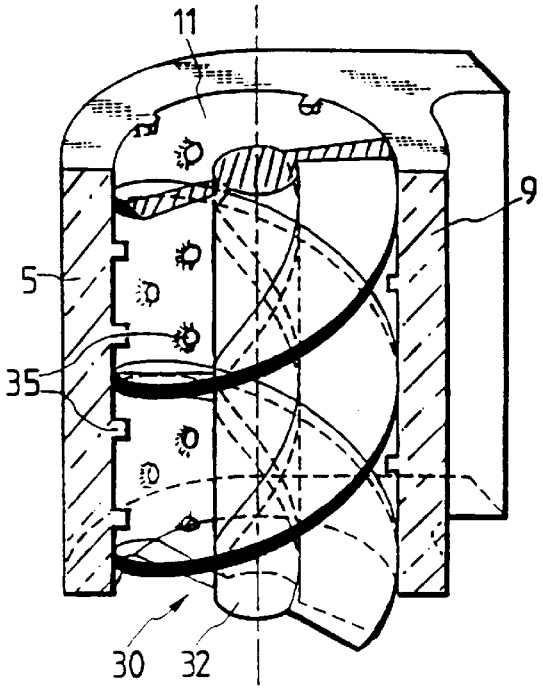
Figure 8:
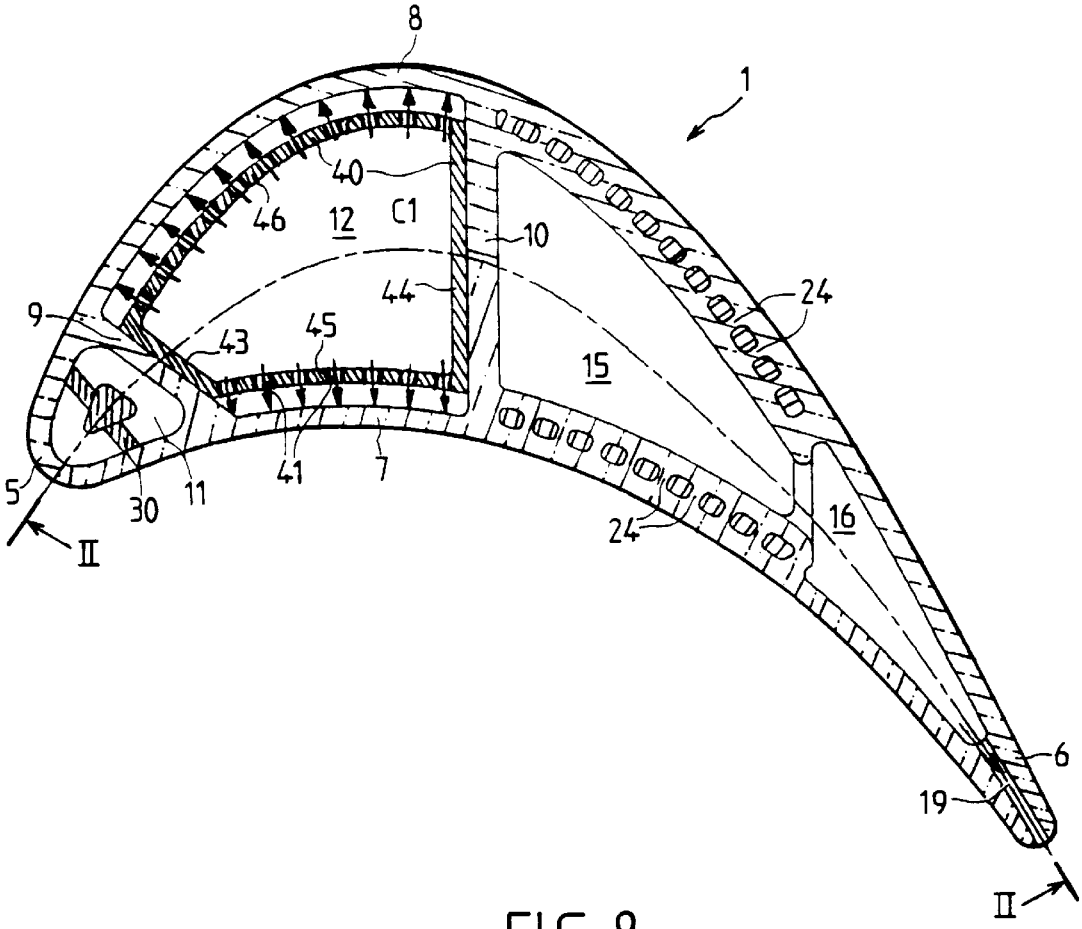
FIGS. 8–10 are transverse cross-sectional views taken at different distances from the vane root and respectively along the lines VIII—VIII, IX—IX and X—X of FIG. 2.
Figure 9:
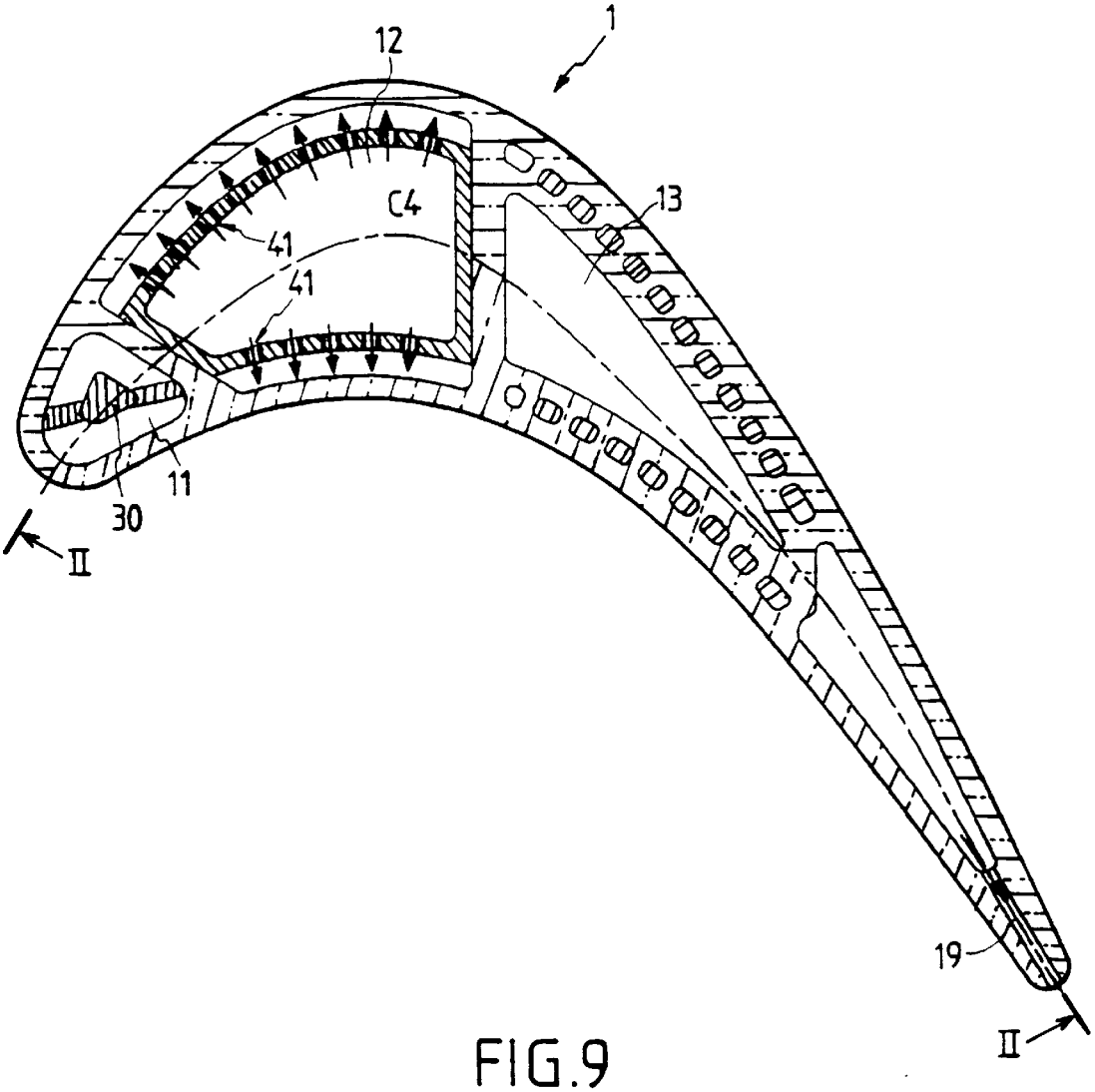
Figure 10:
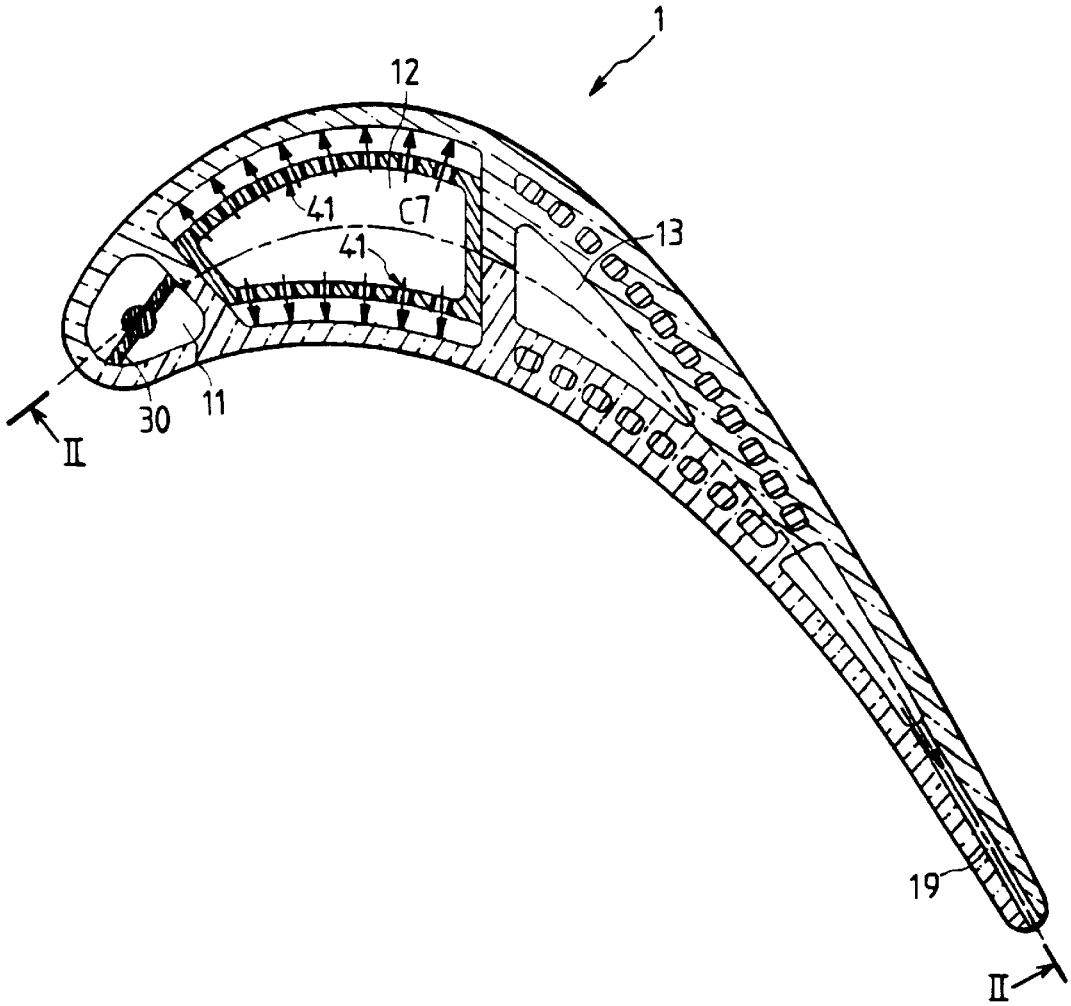

FIG. 7 shows perturbation devices formed by studs 35 which may or may not be arrayed in mutually staggered positions from one tier to the next on the inner wall of the upstream cavity 11.

The above described cooling system is located in the upstream cavity 11 so as to be very near the leading edge 5. However the system may be equally well located in other cooling cavities.

The cooling air in this upstream cavity 11 moves centrifugally outwardly from the vane root 3 to the vane head 5. However the circuit may be reversed, in particular in the stationary turbine nozzle guide vanes for instance. Also several helical ramps may be included in one cavity with reversal of flow direction of the cooling circuit relative to the vane root or head.

The middle cooling cavity 12 is convection-cooled using cascaded impact cooling with cooling air introduced at the lower part of the cavity 12 through the conduit 22 in the vane root 3.

FIGS. 2 and 8 through 11 show a lining 40 fitted into the middle cavity 12. This lining 40 is a mechanical and welded assembly of sheetmetal previously perforated to implement impact orifices 41 and air circulating slots 42, or it may be made directly by casting.

The lining 40 assumes the shape of a chimney comprising two mutually opposite side walls 43 and 44 contacting the insides of the radial walls 9 and 10 and two mutually opposite walls 45 and 46, which include the impact orifices 41 and the slots 42. The walls 45 and 46 are positioned a distance from the inside walls 7 and 8 of the vane 1 by means of projecting elements 47 in the form of transverse ribs formed on the walls 45 and 46 and regularly distributed between the vane root 3 and the vane head 4.

Figure 11:
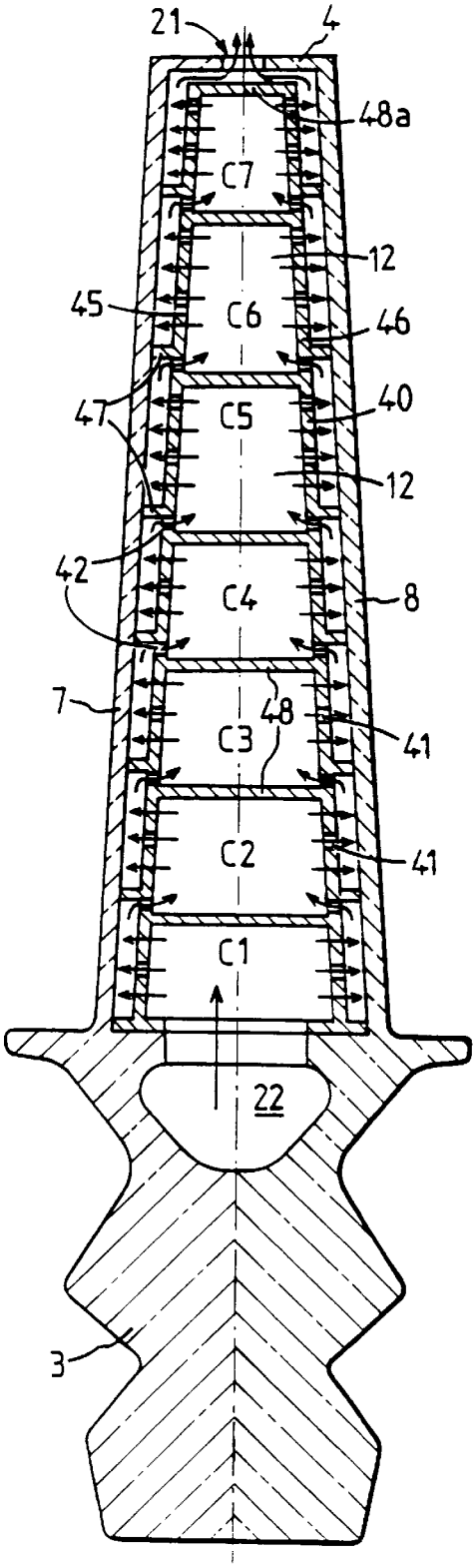
FIG. 11 is a cross-section view of the vane of FIG. 2 in a radial plane extending through a median axis of the middle cooling cavity taken along line XI—XI in FIG. 2.

The inner cavity of the ling 40 is divided into a given number of radially spaced compartments denoted C1 through C7 in FIG. 11 by means of transverse partitions 48 each located (relative to the vane root 3) below a pair of projections 47 contacting inner walls of middle cavity 12 and separated from these projections 47 by two slots 42 opposite the side walls 7 and 8 of the vane 1. The upper wall 48*a* is kept spaced from the wall forming the vane head 4 to allow exhausting of the cooling air evacuated from the head end cavity C7 through 21.

The cooling circuit in the middle cavity 12 is implemented as follows:

The air is fed through the conduit 22 into the compartment C1 of the lining 40 and then is discharged from the compartment C1 through the impact orifices 41 so that the air strikes or impacts the inside walls of the high-pressure side 7 and low-pressure side 8 of the vane 1 in the vicinity of the vane root 3. Following impact, the air is fed through the first circulation slot 42 beneath a rib 47 into the second compartment C2 to be then fed into the third compartment C3. Each slot 42 admits air into the next succeeding compartment from the space between the preceeding compartment and the inside walls of sides 7 and 8 below a rib 47. In this manner the air sequentially moves as far as the upper compartment C7 from where it impacts the inner walls of the high-pressure side 7 and low-pressure side 8 in the vicinity of the vane head 4 and then is exhausted through the orifice 21 from the vane 1.

The number of compartments may be other than seven, and the number of impact orifices 41 may vary from one compartment to the other.

The above described lining 40 also may be mounted inside a cavity near the leading or the trailing edge. This lining may be used in both stationary and moving vane systems. As regards stationary vane systems, the air may be fed through the vane head 4, and the compartments C1 through C7 may be configured radially as in the above embodiment or axially from the leading edge 5 toward the trailing edge 6, or vice-versa. This apparatus is applicable both to distributed impact (several rows of orifices) and to concentrated impact (a single row of orifices 41).

As already mentioned above, the high-pressure side 7 and the low-pressure side 8 of vane 1 comprise double skins 7*a*, 7*b* and 8*a*, 8*b* in the region of the upstream portion 15 of the downstream cavity 13, said skins being connected by bridging elements 24. The inner skins 7*a*, 7*b* and 8*a*, 8*b* are connected near the vane root 3 by the transverse wall 17. These two inner skins 7*b*, 8*b* extend to the vicinity of the wall forming the vane head 4 while providing passages 50*a*, 50*b* near said head through which the air that was taken in at the orifice 23 of the vane root 3 and circulated centrifugally between the skins 7*a*, 7*b* of the high-pressure side 7 and the skins 8*a*, 8*b* of the low-pressure side 8 is exhausted into the upstream portion 15 of the downstream cavity. This cooling air moves centrifugally in this upstream portion 15 and then, through the aperture 18, enters the downstream portion 16. Lastly the air centrifugally rises in the downstream portion 16 and is exhausted through the slots 19 in the trailing edge 6 into the hot gas flow. The cooling air fed through the orifice 23 is split into two flows B1 and B2 by the transverse wall 17. These two flows B1 and B2 centrifugally move through the multitude of bridging elements 24. These bridging elements 23 preferably are cast during manufacture. The bridging elements 24 may be staggered in rows (FIG. 13) or be linearly arrayed as shown in FIG. 14. The shape of the bridging elements is arbitrary, being of cylindrical, square, oblong etc. cross-section. This arrangement also may be used to cool the zones extending as far as the leading edge of the vane.

The internal cooling circuits are implemented by assembling the components, namely the helical ramp 30 and the welded and mechanically mounted lining 40 into one of the half vanes, then by mounting the other half vane on the former and by welding together the assembly of the parts. Moreover the cooling circuits may also be manufactured, in full or in part, directly by casting.

Various modifications to the structure of the preferred embodiments to achieve the same function can be made by the person skilled in the art without departing from the scope of the invention defined by the following claims.

We claim:

1. In a turbine vane comprising a hollow blade (2) radially extending from a vane root (3) to a vane head (4) and including a leading edge (5) and a trailing edge (6) spaced from each other and connected by spaced concave and convex side walls (7, 8) and further including an air cooling system inside the vane that is supplied with cooling air through the vane root (3) and arranged such that the cooling air is directed against the inner surfaces of the side walls, the improvement comprising:

said turbine vane comprising two radial walls (9, 10) spanning said concave (7) and convex (8) side walls and dividing the inside of said vane (1) into an upstream cooling cavity (11) located near the leading edge (5), a middle cooling cavity (12) located between said radial walls (9, 10) and a downstream cooling cavity (13) located adjacent the trailing edge (6);

an air intake (22) at the vane root (3) in communication with air exhaust orifices (20, 21) in the vane head (4) for exhausting cooling air from the upstream and middle cavities (11, 12);

a separate air intake (23) in the vane root (3) in communication with the downstream cavity (13);

a plurality of exhaust slots (19) in the trailing edge (6) in communication with the downstream cavity for exhausting cooling air from the downstream cavity;

said cooling system comprising:

a helical ramp (30) in the upstream cavity extending between the vane root (3) and the vane head (4);

a lining (40) in the middle cavity (12) in contact with the insides of the radial walls (9, 10) and spaced apart a distance from the side walls (7, 8) of the vane (1) by projecting elements (47) extending from the lining, the lining (40) having a plurality of orifices (41) located opposite the vane side walls (7, 8) for directing cooling air against the side walls (7, 8);

a transverse wall (17) in the downstream cavity (13) closing the lower end of said downstream cavity (13);

a third radial wall (14) dividing said downstream cavity (13) into an upstream portion (15) and a downstream portion (16) near the trailing edge (6) of the vane;

said exhaust slots (19) at the vane trailing edge in communication with said downstream portion (16);

an aperture (18) at the base of said third wall (14) providing communication between the upstream and downstream portions of said downstream cavity;

the vane side walls (7, 8) facing the upstream portion comprising double skins (7*a*, 7*b*, 8*a*, 8*b*) connected by bridging elements (24);

whereby cooling air fed in at the vane root (3) and flowing between said double skins enters the upstream portion (15) at the vane head (4) and then flows to the downstream portion (16) through said aperture (18) and then is exhausted through said exhaust slots (19).

2. The vane as claimed in claim 1, wherein the inner wall of the upstream cavity (13) comprises air flow perturbation elements (33, 34, 35).

3. The vane as claimed in claim 2, wherein the perturbation elements (33) comprise ribs.

4. The vane as claimed in claim 2, the helical ramp including a core (32); and wherein the perturbation elements comprise bridging elements (34) connecting the inner wall of the upstream cavity to the core (32) of the helical ramp.

5. The vane as claimed in claim 2, wherein the perturbation elements comprise studs (35).

6. The vane as claimed in claim 1, wherein the lining of the middle cavity (12) comprises a plurality of radially juxtaposed compartments (C1 through C7) in communication with each other via openings (41) in side walls of the lining and slots (42) providing communication between said compartments; the compartment closest to the vane root (3) being in communication with a supply of cooling air.

7. The vane as claimed in claim 6, wherein the projecting elements (47) comprise transverse ribs spanning and radially dividing the space between the lining and the inner side walls of the middle cavity; and said slots (42) are located radially inwardly of said projections (47) to provide communication between said space and the next radially outwardly located compartment; each compartment in communication with said space via said openings (41) in the lining sidewalls, whereby cooling air supplied to a first of said compartments (C1) centrifugally flows into the space between the first compartment side wall and the inner side wall of the middle cavity via the apertures in the lining, impacts the inner side wall of the vane, flows into the next compartment via said slots (42) and then flows outwardly into the next radially outward space between the lining and the inner wall of the middle cavity in sequence until the last compartment, whereupon the air exits the middle cavity via its air exhaust orifice.

* * * * *